US009723398B2

(12) United States Patent
Chang

(10) Patent No.: US 9,723,398 B2
(45) Date of Patent: Aug. 1, 2017

(54) SPEAKER

(71) Applicant: HON HAI PRECISION INDUSTRY CO., LTD., New Taipei (TW)

(72) Inventor: Jen-Tsorng Chang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 97 days.

(21) Appl. No.: 14/718,323

(22) Filed: May 21, 2015

(65) Prior Publication Data

US 2016/0100247 A1 Apr. 7, 2016

(30) Foreign Application Priority Data

Oct. 7, 2014 (CN) ..... 2014 1 0519078

(51) Int. Cl.
*H04R 1/28* (2006.01)
*H04R 7/04* (2006.01)

(52) U.S. Cl.
CPC ..... *H04R 1/2807* (2013.01); *H04R 7/045* (2013.01); *H04R 2420/07* (2013.01)

(58) Field of Classification Search
CPC ..... H04R 1/2807
USPC ..... 381/351, 182
See application file for complete search history.

(56) References Cited

U.S. PATENT DOCUMENTS

2006/0233402 A1* 10/2006 Inagaki ..... H04R 1/025 381/182
2012/0183158 A1* 7/2012 Tracy ..... H04R 1/26 381/120

* cited by examiner

*Primary Examiner* — Duc Nguyen
*Assistant Examiner* — Phan Le
(74) *Attorney, Agent, or Firm* — Steven Reiss

(57) ABSTRACT

A modular loudspeaker includes a plurality of chambers and a plurality of vibration plates. Each vibration plate is fixed to two chambers, to cause the chambers to be secured to each other in a certain orientation by the vibration plates. A vibrator is attached to each vibration plate. A processor and a wireless communication unit are received in each chamber. The vibrator attached to each vibration plate is electrically connected to the processor, and the processor is configured to control the vibrator to vibrate when the loudspeaker receives a wireless audio signal via the wireless communication unit, thereby causing the vibration plate to vibrate and output sound.

9 Claims, 4 Drawing Sheets

SPEAKER

FIELD

The subject matter herein generally relates to audio presentation.

BACKGROUND

A speaker is an energy transducer that transforms an electrical signal to mechanical vibration. Then, the ambient air around the speaker is pushed and pulled by the mechanical vibration to generate sound.

BRIEF DESCRIPTION OF THE DRAWINGS

Implementations of the present technology will now be described, by way of example only, with reference to the attached figures.

DETAILED DESCRIPTION

Figure 1:
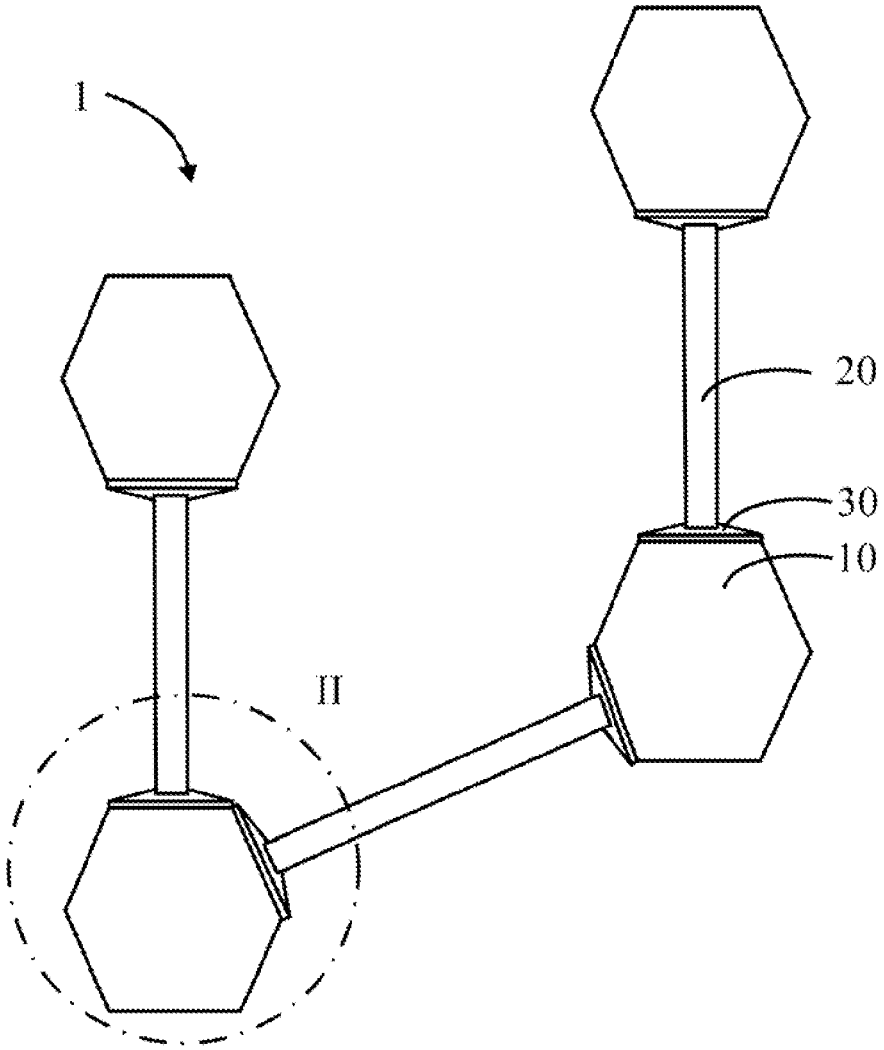
FIG. 1 is an isometric view of an embodiment of a speaker.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
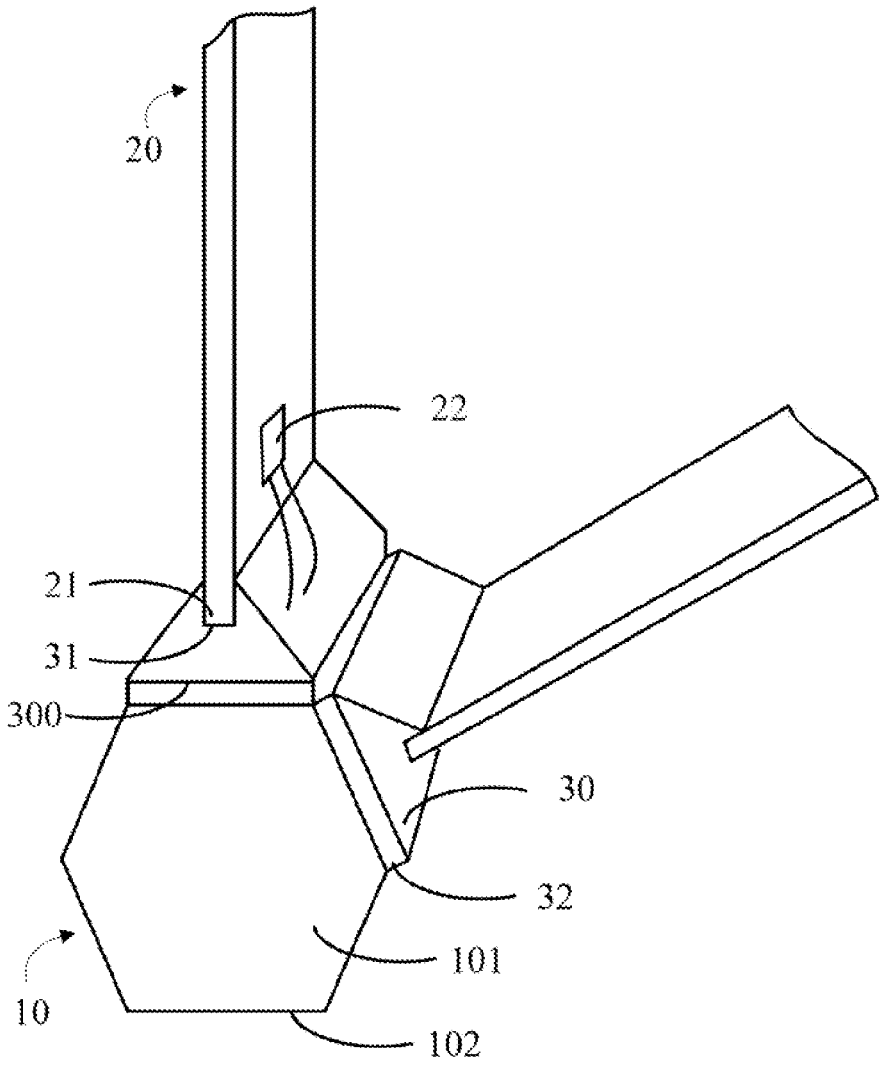
FIG. 2 is an enlarged view of circled portion II in FIG. 1.
Figure 3:
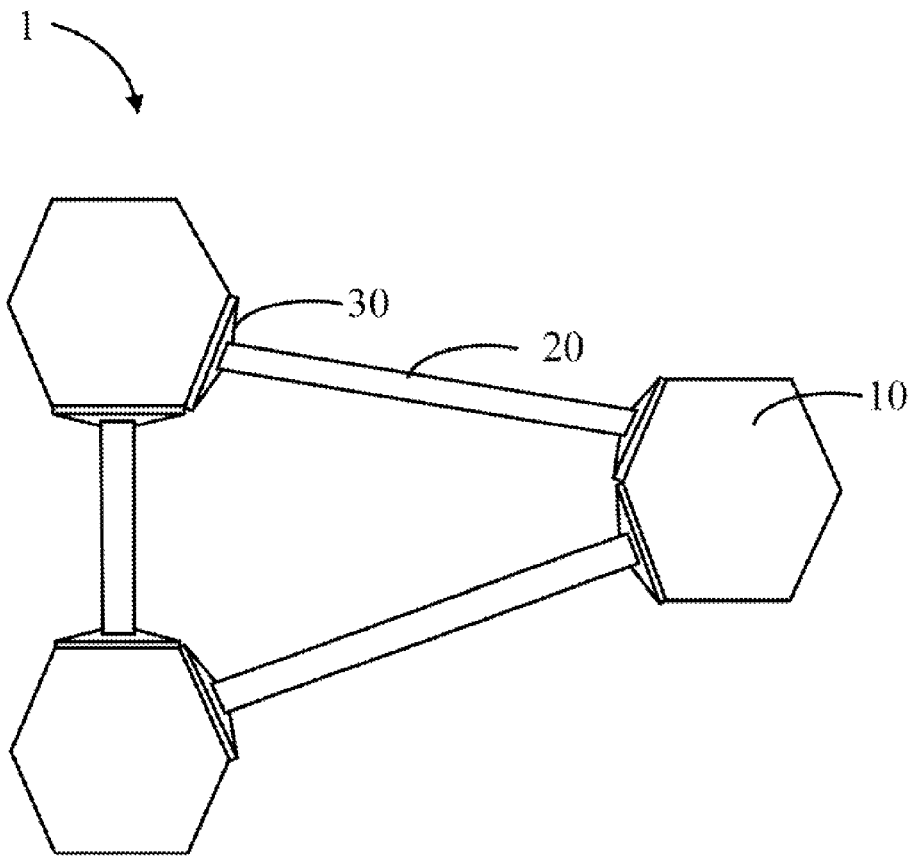
FIG. 3 is similar to FIG. 1, but showing a second embodiment of a speaker.

FIG. 1 illustrates an embodiment of a speaker 1. The speaker 1 includes a number of chambers 10 and a number of vibration plates 20 (FIG. 1 only shows four chambers 10 and three vibration plates 20). Each vibration plate 20 can be substantially rectangular, and can be made of metal or glass. FIG. 2 illustrates that each end portion 21 of each vibration plate 20 is secured to a chamber 10 via a securing portion 30, to cause the chambers 10 to be secured to each other by the vibration plates 20. In other embodiments, a number of the chambers 10, a number of the vibration plates 20, a distance between each two chambers 10, and an included angle between each two vibration plates 20 can be varied, thereby allowing the speaker 1 to show different appearances (see FIG. 3).

Figure 4:
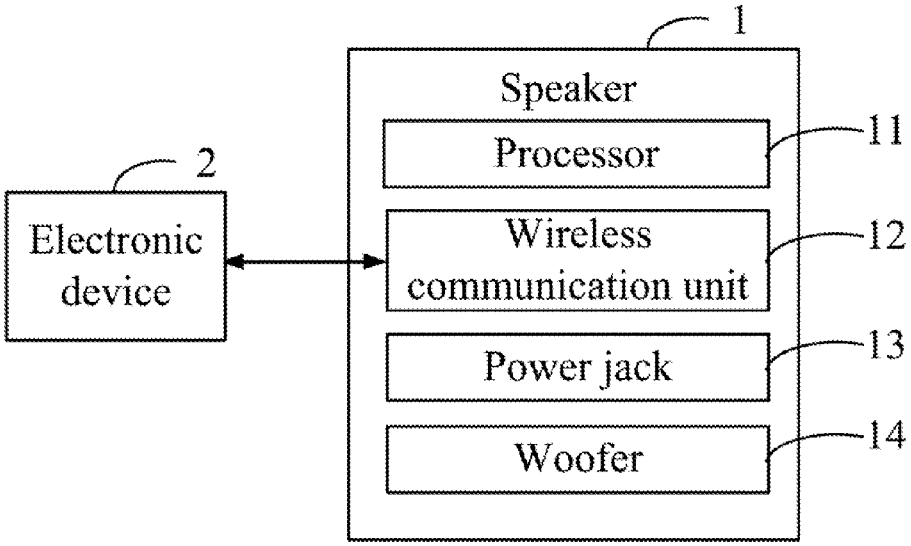
FIG. 4 is a block diagram of the speaker of FIG. 1.

A vibrator 22 is attached to each vibration plate 20. FIG. 4 illustrates that the speaker 1 further includes a processor 11 and a wireless communication unit 12 received in each chamber 10. Each vibrator 22 is electrically connected to one processor 11. When the speaker 1 receives a wireless audio signal via the wireless communication unit 12 from an electronic device 2 (such as a smart phone or a tablet computer), the processor 11 controls the vibrator 22 to vibrate, thereby causing the vibration plate 20 to vibrate and output sound. The wireless communication unit 12 can be a BLUETOOTH® communication unit or WIFI communication unit.

In at least one embodiment, the speaker 1 further includes a woofer 14 (shown in FIG. 4) electrically connected to each processor 11. When the speaker 1 receives the wireless audio signal via the wireless communication unit 12, the processor 11 further controls the woofer 14 to output low frequency sound.

In at least one embodiment, each chamber 10 is substantially polyhedral-shaped. Specifically, each chamber 10 includes two bottom covers 101 and a number of sidewalls 102. Each vibration plate 20 is secured to one of the sidewall 102 of the chamber 10 via the securing portion 30. The woofer 14 is located at one of the bottom covers 101 of the chamber 10. The speaker 1 further includes a power jack 13 (shown in FIG. 4) located at one of the bottom covers 101. One or more batteries (not shown) for the speaker 1 can be charged via the power jack 13. The power jack 13 can be a USB power jack or a wireless power jack.

In at least one embodiment, a bottom surface 300 of each securing portion 30 facing a chamber 10 includes a magnet 32. The chamber 10 is made of iron or iron alloy. As such, each securing portion 30 can be secured to a chamber 10 by an attractive force between the magnet 32 and the chamber 10.

In at least one embodiment, each securing portion 30 defines a receiving slot 31. The vibration plate 20 is fixedly received in the receiving slot 31, thereby securing the vibration plate 20 to the securing portion 30. The receiving slot 31 further includes an anti-vibration member (not shown). The anti-vibration member is able to absorb a major portion of impacts between the vibration plate 20 and the receiving slot 31, and prevent the vibration plate 20 from being damaged. The anti-vibration member can be made of flexible material such as rubber.

Even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A speaker comprising:

a plurality of chambers;

a plurality of vibration plates, each of the plurality of vibration plates comprising two opposite end portions, each end portion of each of the plurality of vibration plates secured to one of the plurality of chambers, to cause the plurality of chambers to be secured to each other by the plurality of vibration plates;

a vibrator attached to each of the plurality of vibration plates;

a wireless communication unit received in each of the plurality of chambers; and a processor received in each of the plurality of chambers, each vibrator electrically connected to one processor, the processor configured to control the vibrator to vibrate when the speaker receives a wireless audio signal via the wireless communication unit, thereby causing the vibration plate to vibrate and output sound.

2. The speaker of claim 1, further comprising a woofer electrically connected to each processor, wherein the processor is further configured to control the woofer to output low frequency sound when the speaker receives the wireless audio signal via the wireless communication unit.

3. The speaker of claim 2, wherein each of the plurality of chambers comprises two bottom covers and a plurality of sidewalls; each of the plurality of vibration plates is secured to one of the plurality of sidewalls of the chamber; the woofer is located at one of the bottom covers of the chamber.

4. The speaker of claim 3, further comprising a power jack, wherein the power jack is located at one of the bottom covers.

5. The speaker of claim 4, wherein the power jack is a USB power jack or a wireless power jack.

6. The speaker of claim 1, wherein the two end portions of each of the plurality of vibration plate are respectively secured to two of the plurality of chambers via two securing portions.

7. The speaker of claim 6, wherein a bottom surface of each securing portion facing a chamber comprises a magnet; the chamber is made of iron or iron alloy; each securing portion is secured to a chamber by an attractive force between the magnet and the chamber.

8. The speaker of claim 6, wherein each securing portion defines a receiving slot; the vibration plate is fixedly received in the receiving slot.

9. The speaker of claim 1, wherein each of the plurality of vibration plates is made of metal or glass.

* * * * *